United States Patent [19]

Kita

[11] 4,050,525

[45] Sept. 27, 1977

[54] DOWN-THE-HOLE HAMMER

[75] Inventor: John F. Kita, Bedford, Pa.

[73] Assignee: Kennametal Inc., Latrobe, Pa.

[21] Appl. No.: 720,057

[22] Filed: Sept. 2, 1976

[51] Int. Cl.[2] ..... B23Q 5/027

[52] U.S. Cl. ..... 173/17; 173/66; 173/73; 91/232; 92/222

[58] Field of Search ..... 29/182.8; 91/232; 92/222; 145/29; 173/17, 66, 73, 127, 135

[56] References Cited

U.S. PATENT DOCUMENTS

| | | | |
|---|---|---|---|
| 643,063 | 2/1900 | Johnson | 91/232 |
| 799,406 | 9/1905 | Schmucker | 173/17 |
| 957,708 | 5/1910 | Padbury | 91/232 |
| 1,108,834 | 8/1914 | Detrick | 173/135 X |
| 1,160,578 | 11/1915 | Clement | 91/232 |
| 2,800,884 | 7/1957 | Mori | 173/73 |
| 3,606,930 | 9/1971 | Curington | 173/17 X |
| 3,804,181 | 4/1974 | Curington et al. | 173/17 |
| 3,809,540 | 5/1974 | Mal et al. | 29/182.8 |

FOREIGN PATENT DOCUMENTS

| | | | |
|---|---|---|---|
| 8,631 of | 1903 | United Kingdom | 91/232 |

*Primary Examiner*—Lawrence J. Staab
*Attorney, Agent, or Firm*—Melvin A. Crosby

[57] ABSTRACT

A down-the-hole hammer of the type adapted for receiving a bit at the lower end and for being connected to the lower end of a drill string through which compressed air is supplied to the hammer. The supply of air to the hammer when the bit at the lower end is resting on the bottom of the hole causes a piston in the hammer to reciprocate and to beat upon the upper end of the bit so that the material at the bottom of a hole is reduced. The piston, by reciprocating in the hammer, accomplishes the valving of the fluid which causes the piston to reciprocate, and when the hammer is lifted from the bottom of the hole and the bit moves downwardly, the piston ceases reciprocation while air blows off through the bit to the bottom thereof to clear debris from the hole being drilled.

7 Claims, 3 Drawing Figures

DOWN-THE-HOLE HAMMER

The present invention relates to down-the-hole hammers of the type for beating on a bit for reducing a formation which is engaged by the bit.

Down-the-hole hammers of the nature referred to are widely known and take many forms, but quite often embody rather complex valving arrangements for controlling the supply of actuating fluid which effect reciprocation of the piston element which impacts on the upper end of the bit which is carried by the lower end of the hammer.

A primary object of the present invention is the provision of a down-the-hole hammer in which the valving of the actuating fluid is carried out in an extremely simple manner by movement of the piston in the hammer while maintaining efficient conditions of operation so that the piston will deliver strong impacts to the bit during operation of the hammer.

Another object is the provision of a down-the-hole hammer of the nature referred to which is relatively inexpensive to construct and which has long useful life.

BRIEF SUMMARY OF THE INVENTION

According to the present invention, a down-the-hole hammer is provided having an outer casing which, at the upper end, is adapted for connection to a fitting which, in turn, is adapted for connection to the lower end of a drill string through which air under pressure is supplied. The aforementioned fitting includes a check valve arrangement so that the fluid in the drill string can flow therefrom into the fitting, but not vice versa.

Within the casing, there is arranged a valve sleeve which is clamped in place by the fitting and which valve sleeve has reciprocably mounted therein a piston, preferably of cemented carbide material.

The lower end of the casing is adapted for receiving a second fitting which can be referred to as a chuck and within which is reciprocably mounted a bit which is advantageously splined to the chuck and which has a lower end adapted for engaging a formation to be reduced and an upper end positioned to be impacted by the piston when the piston is driven downwardly.

In operation, the drill string is moved downwardly to bring the lower end of a bit into engagement with the formation to be reduced, and when this is accomplished, the piston will reciprocate automatically within the valve sleeve and impact on the bit.

When the hammer is elevated so that the bit drops downwardly therein, the piston moves downwardly and interrupts the valving action which the piston normally accomplishes and, instead, fluid under pressure passes completely through the down-the-hole hammer and bit and out the bottom end of the bit and flushes reduced material out of the hole being drilled.

The exact nature of the present invention will become more apparent upon reference to the following detailed specification taken in connection with the accompanying drawings in which.

DETAILED DESCRIPTION OF THE INVENTION

Figure 1:
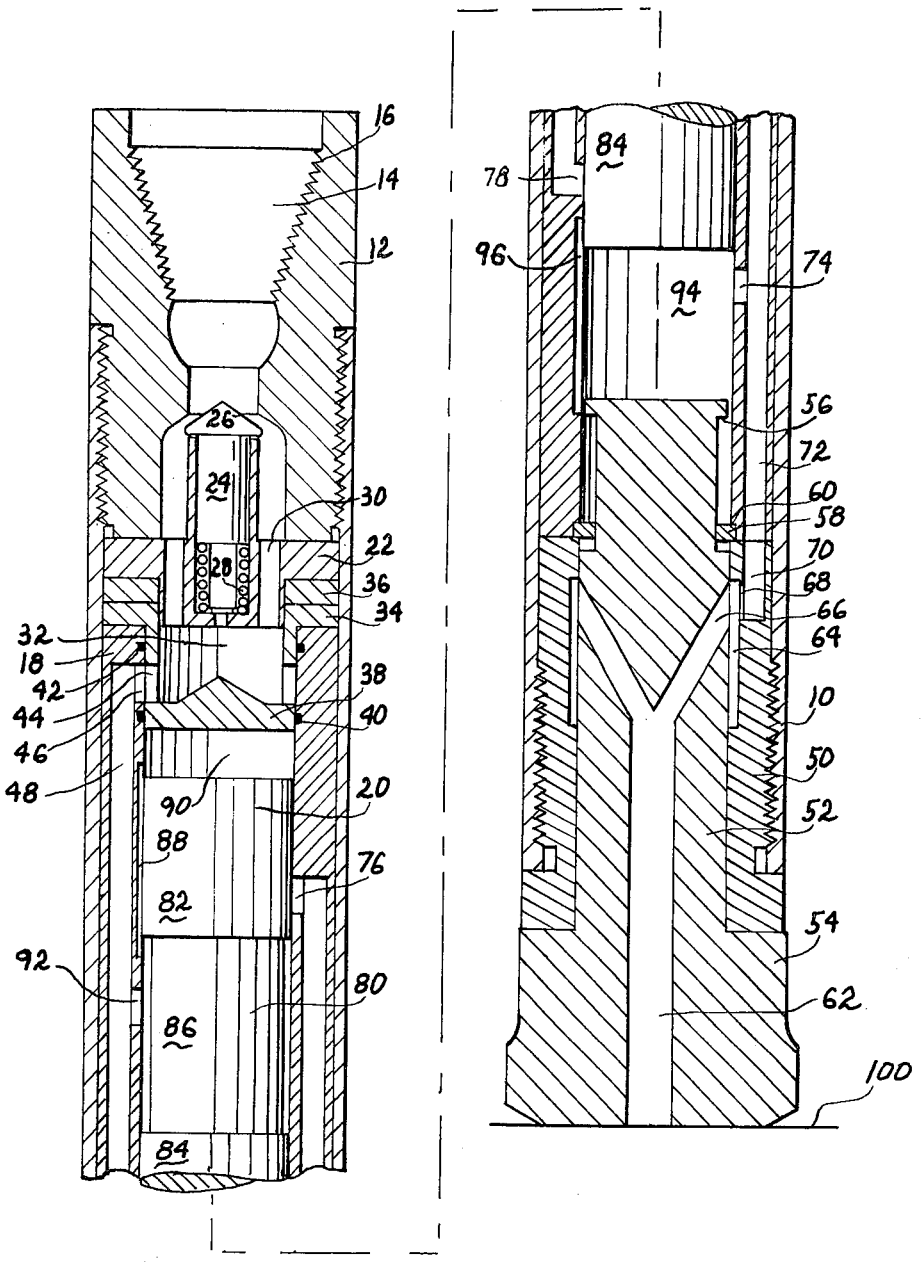
FIG. 1 is a vertical sectional view showing the down-the-hole hammer with the bit resting on a formation to be reduced and with the piston substantially at the uppermost end of the stroke thereof and commencing to move downwardly.

Referring to the drawings somewhat more in detail, a down-the-hole hammer according to the present invention comprises an outer casing 10 having a fitting 12 fitted into the upper end thereof with fitting 12 being provided with a central axial passage 14 having internal threads 16 for connection to the end of a drill string.

Within casing 10, there is also a sleeve member 18 having passages therein and ports extending radially outwardly and communicating with the aforementioned passage and with the ports being controlled by a piston 20 reciprocably mounted within sleeve member 18.

Between the upper end of sleeve member 18 and the lower end of fitting 12 there is clamped a first valve element 22 adjacent fitting 12 and having therein a check valve member 24 adapted to cooperate with valve seat 26 in passage 14 and biased by spring 28 toward the said seat and adapted for being moved awy from the seat by the pressure of fluid flowing downwardly in passage 14.

Member 22 has axial passages 30 therein which communicate at the upper end with the central passage 14 and fitting 12 while, at the lower end, opening into a central cavity 32 formed in a flanged member 34 adjacent the upper end of sleeve 18. A spacing ring 36 is disposed between member 22 and the flange on member 34 and the three parts referred to are clamped between fitting 12 in the upper end of sleeve 18.

The member 34 at the lower end has a disc-like portion 38 which is sealed to the inside of sleeve 18 as by O-ring 40. The upper portion of member 34 near the upper end of sleeve 18 is also sealed therein by the O-ring indicated at 42. The central cavity 32 of member 34 has radial ports 44 which communicate with radial ports 46 formed in the upper end of sleeve 18 and which ports 46 communicate with axial passage means 48 formed in the sleeve member 18.

The lower end of casing 10 is threaded for receiving a chuck 50 which is adapted for reciprocably receiving the upper shank portion 52 of a down-the-hole bit having working head portion 54. At the upper end of shank 52 of the down-the-hole bit is an undercut region 56 adapted for receiving a split ring 58 which is clamped in a hammer notch 60 formed in the inside of the lower end of sleeve member 18 by the upper end of chuck 50. Advantageously, the shank of the bit and the chuck are interconnected by axial spline means which permit reciprocation of the bit in the chuck while causing the bit to rotate as the drill string is rotated.

The bit has a central axial passage 62 extending upwardly therein in the lower end and branching outwardly to the outer surface of the shank 52 of the bit beneath the lower end of axial recess 56. On the inside of chuck 50 there is formed an axially extending annular recess 64 with which the upper end regions 66 of passage 62 in the bit communicate in all positions of the bit.

For example, it will be noted that the bit in FIG. 1 occupies its uppermost position in chuck 50 and that, in the lowermost position which the bit can occupy as determined by engagement of the upper end of recess 56 with split ring 58, the upper end 66 of passage 62 will remain in communication with annular recess 64 in the chuck.

Recess 64 in the chuck communicates via radial holes 68 in the chuck with axial passage means 70 extending upwardly in the chuck to the upper end thereof. At the upper ends of passages 70, passages 70 communicate with axial passages 72 formed in sleeve member 18. The last mentioned passages communicate with the inside of sleeve member 18 via first radial ports 74 at a lower level and second ports 76 at an upper level.

Referring again to passage means 48 formed in sleeve member 18, it will be noted that passage means 48 communicates with the inside of sleeve member 18 via port means 78 located axially between port means 74 and port means 76.

Figure 2:
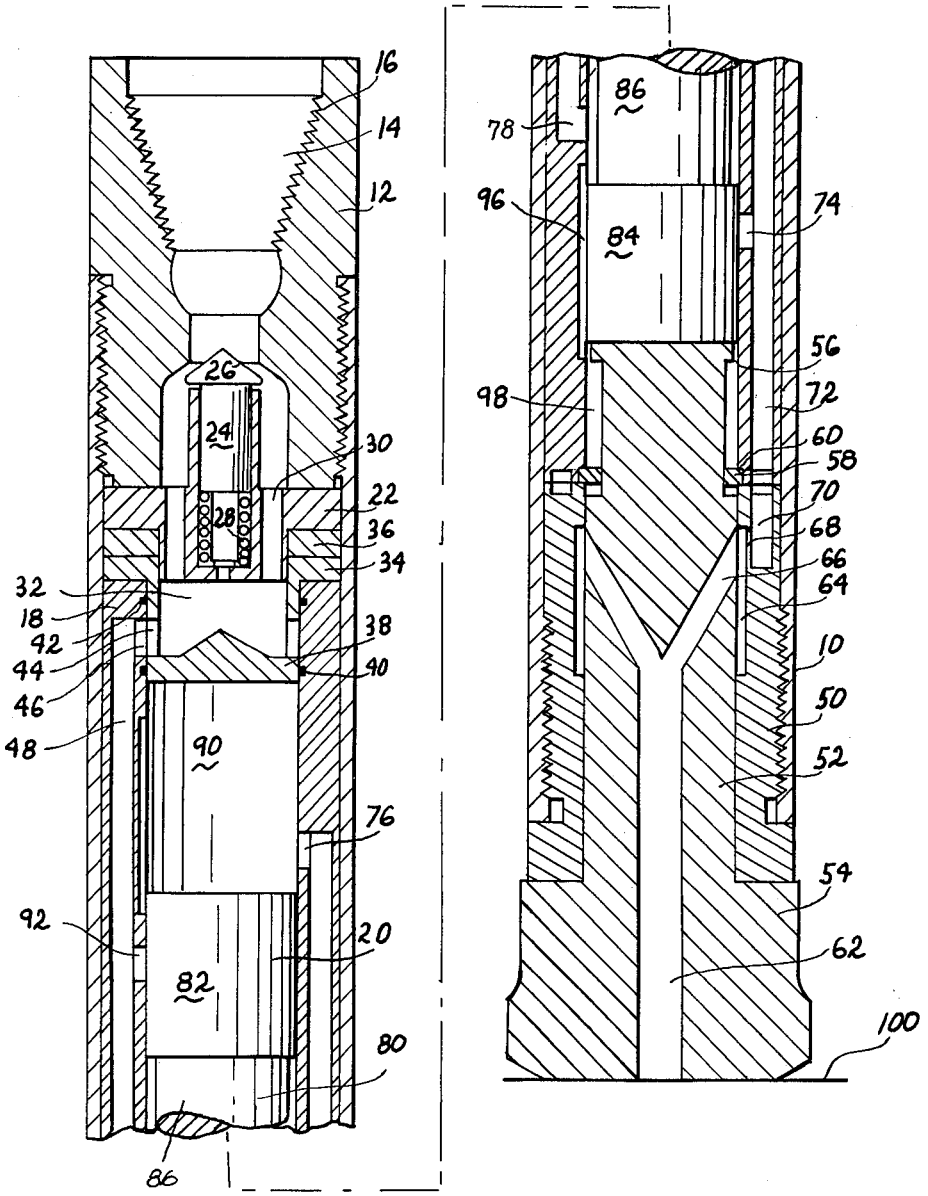
FIG. 2 is a view like FIG. 1 but shows the piston in its lowermost position impacting against the upper end of the bit.

It will also be noted that the hammer includes a piston 80 reciprocably mounted in sleeve member 18 and having an upper position in which it is shown in FIG. 1 and a lower position in which it is shown in FIG. 2.

Piston 80 has upper and lower spool portions 82 and 84 connected by reduced diameter portion 86. When the pistion is in its uppermost position, groove means 88 formed on the inside of sleeve member 18 communicates space 90 above spool portion 82 wih the reduced diameter region 86 of the piston so that high pessure fluid in passage 48 can flow axially inwardly via port means 92 into the reduced diameter region of piston 80 and then upwardly along groove means 88 and into space 90 so as to bias piston 80 in the downward direction.

At the same time, when piston 80 is in its FIG. 1 position, the space 94 beneath the piston is exhausted to the atmosphere via port means 74, axial passage means 72 and 70, and passage 62 in the hammer. It will be noted that the inside of sleeve member 18 is provided with axial passage means 96 extending along space 94 and the purpose of which will become apparent upon reference to FIG. 2.

In FIG. 2, it will be noted that piston 80 has moved downwardly to the point that the lower end of the piston is impacting against the upper end of the bit. At this time, spool portion 82 of the piston covers port means 92 while simultaneously uncovering port means 76 thereby exhausting space 90 in sleeve member 18 which is above spool portion 82 of piston 80. Further, during the downward movement of the piston 80, spool portion 84 thereof covers port means 74 while uncovering port means 78.

The space 90 above the piston is now exhausted through bht bit to the atmosphere while high pressure fluid flows down passage means 48 and radially inwardly through port means 78 and downwardly through axial groove means 96 and into the space 98 surrounding the upper end of the shank 52 of the bit. At this point, it will be noted that the upper end of the bit is slightly smaller in diameter than spool portion 84 of piston 80 so that, when the piston is in its FIG. 2 position, there is an upward force exerted thereon by the high pressure fluid.

The upward force acting on the piston will drive it upwardly to, or near, the FIG. 1 position thereof, and the cycle which has been described above will then be repeated. It will, thus, be seen that the piston repeatedly impacts against the upper end of the bit and this drives the bit downwardly against the formation 100 to be reduced and is effective for reducing the formation.

As mentioned, the piston is preferably formed of a cemented carbide material, such as tungsten carbide, and is, thus, long wearing, has no tendency to become deformed by the repeated impacts and, therefore, will remain freely reciprocable in the central bore in sleeve member 18 while, at the same time, is substantially heavier than steel and can, thus, impart greater energy to the bit than a steel piston of the same size traveling at the same distance and at the same velocity.

Figure 3:
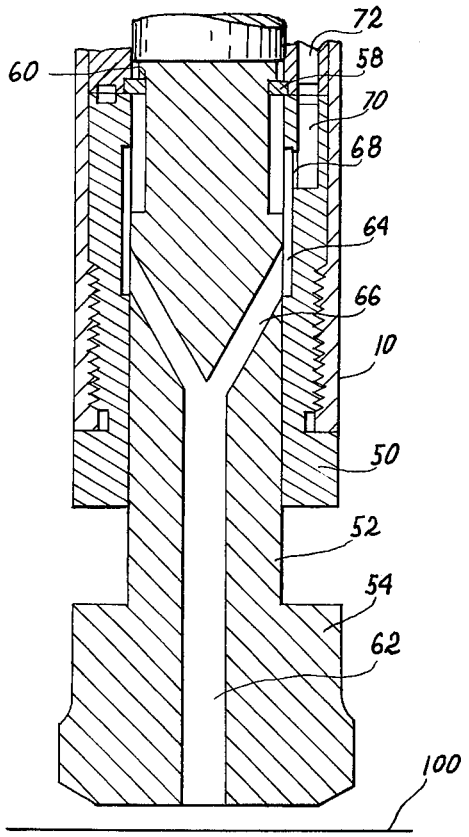
FIG. 3 is a fragmentary view showing the hammer lifted off the bottom of the hole with the bit in a lowered and idle position thereof.

FIG. 3 shows the motor lifted until the bit slides downwardly in chuck 50 so as to hang on split ring 58. At this time, the piston rests on the upper end of the bit but does not reciprocate in the central bore in sleeve member 18 while pressure fluid supplied to the drill string will pass freely through the motor and downwardly through the central passage in the bit and keep the debris blown away from the bottom of the hole being drilled.

When the bit is hanging in the hammer, as shown in FIG. 3, the fluid flow through the hammer is from passage 14 downwardly through the check valve structure and then through passage means 48 and then inwardly through port means 78 into the reduced diameter portion of piston 80 and then through port means 74 into passage means 72 and thence outwardly through the passage 62 in the bit.

From the foregoing, it will be seen that, within sleeve member 18, passage means 48 can be considered to be pressure passage means through which pressure fluid is supplied to piston 80 whereas passage means 72 form exhaust passage means which are continuously connected with the atmosphere and, therefore, provide means for exhausting working fluid from the opposite ends of the piston.

All valving necessary for causing the piston to reciprocate in sleeve member 18 and to beat upon the upper end of the bit is accomplished by movement of the piston within sleeve member 18. Operation of the hammer can be initiated by lowering the down-the-hole hammer until the bit engages the formation to be reduced and moves upwardly in the hammer to its FIG. 1 position while the operation of the motor can be interrupted by lifting the hammer until the bit hangs therein as it is shown in FIG. 3.

It will be appreciated that, because of the simplicity of construction of the piston, and the fact that the piston has no central bore therein, it can be formed of an extremely hard wear resistant material, such as cemented carbide material, and, in particular, carbide material comprising tungsten carbide.

Modifications may be made within the scope of the appended claims.

What is claimed is:

1. In a down-the-hole hammer; a housing defining a cylindrical cavity and having first means at the upper end for connection to a source of air under pressure and second means at the lower end for connection to a bit having axial exhaust passage means therein and an upper working position and a lower idle position in said housing, a reciprocable piston dividing the cavity into upper and lower chambers and having retracted and advanced positions in the cavity and adapted in advanced position to strike the upper end of a bit in working position in the housing, said piston having end portions fitting said cavity and a reduced diameter region between said end portions, first conduit means in the housing adapted for the continuous supply of air under pressure thereto, second conduit means in the housing continuously connected to exhaust, first port means connecting said first conduit means to the reduced diameter region of said piston, second and third axially spaced port means leading from said second conduit means into said cavity, said piston controlling said second and third port means and causing said second and third port means to communicate with respective ones of the upper and lower chambers in advanced and retracted positions respectively of said piston, and channel means in said housing operable for connecting the reduced diameter region of said piston with a respective one of said upper and lower chambers in retracted and advanced positions respectively of said piston, the bit when in idle position in the housing permitting the piston to advance beyond said advanced position thereof and cause said reduced diameter region of said piston to interconnect said first port means and said seond port means thereby exhausting said first conduit means.

2. A down-the-hole hammer according to claim 1 in which said first conduit means comprises a member on the upper end of the housing adapted for connection to the lower end of a drill string through which air under pressure is supplied and including a downwardly opening check valve.

3. A down-the-hole hammer according to claim 1 in which said channel means are formed in the inside wall of said housing and each bypassing a respective end portion of said piston in a respective one of the advanced and retracted positions thereof.

4. A down-the-hole hammer according to claim 1 in which the bit has an exhaust passage means comprising a bore exending into the bit from the bottom thereof and terminating in port means formed in the side of the bit, the inside of said housing having axial groove means formed therein which connect the port means in the side of the bit with said second axial passage means in all positions of the bit in the housing.

5. A down-the-hole hammer according to claim 1 in which said housing includes an outer sleeve like portion and a cylindrical portion disposed therein with the cylindrical portion having said axial passage means and said first, second, and third port means formed therein.

6. A down-the-hole hammer according to claim 1 in which said piston is formed of cemented hard carbide material.

7. A down-the-hole hammer according to claim 6 in which said carbide material comprises tungsten carbide.

* * * * *